US009617830B2

(12) United States Patent
Minassa et al.

(10) Patent No.: US 9,617,830 B2
(45) Date of Patent: Apr. 11, 2017

(54) DOWNHOLE CHEMICAL INJECTION SYSTEM HAVING A DENSITY BARRIER

(71) Applicant: Halliburton Energy Services, Inc., Houston, TX (US)

(72) Inventors: Lorenzzo Breda Minassa, Spring, TX (US); Ahmed Jasser, Tomball, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 136 days.

(21) Appl. No.: 14/434,593

(22) PCT Filed: Nov. 15, 2012

(86) PCT No.: PCT/US2012/065223

§ 371 (c)(1),
(2) Date: Apr. 9, 2015

(87) PCT Pub. No.: WO2014/077814

PCT Pub. Date: May 22, 2014

(65) Prior Publication Data

US 2015/0292301 A1 Oct. 15, 2015

(51) Int. Cl.
*E21B 43/16* (2006.01)
*E21B 41/00* (2006.01)
(Continued)

(52) U.S. Cl.
CPC ..... *E21B 41/00* (2013.01); *E21B 34/06* (2013.01); *E21B 37/06* (2013.01); *E21B 43/16* (2013.01); *E21B 43/162* (2013.01)

(58) Field of Classification Search
CPC ..... E21B 41/00; E21B 43/162; E21B 37/06; E21B 34/06; E21B 43/16
See application file for complete search history.

(56) References Cited

U.S. PATENT DOCUMENTS 3,627,043 A 12/1971 Brown
4,467,867 A * 8/1984 Baker ..... E21B 33/1294 166/188
(Continued)

FOREIGN PATENT DOCUMENTS

GB 2442667 A 4/2008
WO WO2014077814 5/2014

OTHER PUBLICATIONS

Supplementary European Search Report issued by the European Patent Office regarding European Application No. EP12888264 dated Jun. 8, 2016, 7 pages.
(Continued)

*Primary Examiner* — Giovanna C Wright
*Assistant Examiner* — Brandon Duck
(74) *Attorney, Agent, or Firm* — Haynes and Boone LLP

(57) ABSTRACT

A downhole chemical injection system for positioning in a well. The system includes a generally tubular mandrel having an axially extending internal passageway and an exterior. The mandrel includes an injection port in fluid communication with the internal passageway or the exterior of the mandrel. A chemical injection line is coupled to the mandrel and is operable to transport a treatment fluid from a surface installation to the mandrel. A check valve is supported by the mandrel and is in downstream fluid communication with the chemical injection line. A density barrier is fluidically positioned between the check valve and the injection port. The density barrier has an axial loop and a circumferential loop relative to the mandrel forming an omnidirectional low density fluid trap, thereby preventing migration of production fluid from the injection port to check valve regardless of the directional orientation of the well.

20 Claims, 4 Drawing Sheets

(51) Int. Cl.
*E21B 37/06* (2006.01)
*E21B 34/06* (2006.01)

(56) References Cited

U.S. PATENT DOCUMENTS

| | | | | |
|---|---|---|---|---|
| 7,198,099 | B2 | 4/2007 | Lugtmeier et al. | |
| 2003/0010847 | A1 | 1/2003 | Curran et al. | |
| 2005/0178560 | A1 | 8/2005 | Johansen et al. | |
| 2006/0021750 | A1 | 2/2006 | Lugtmeier et al. | |
| 2007/0193733 | A1* | 8/2007 | Basmajian | E21B 23/04 166/66.6 |
| 2007/0277878 | A1 | 12/2007 | Strattan et al. | |
| 2011/0247798 | A1 | 10/2011 | June et al. | |
| 2011/0247828 | A1* | 10/2011 | Patel | E21B 21/00 166/348 |
| 2013/0048303 | A1* | 2/2013 | Patel | E21B 34/10 166/373 |

OTHER PUBLICATIONS

Examination Report issued by the Canadian Patent Office regarding Canadian Application No. 2889121 dated Jul. 6, 2016.
International Search Report and Written Opinion issued by the Korean Intellectual Property Office regarding PCT/US2012/065223 dated May 10, 2013, 9 pages.

* cited by examiner

DOWNHOLE CHEMICAL INJECTION SYSTEM HAVING A DENSITY BARRIER

CROSS-REFERENCE TO RELATED APPLICATIONS

This application is a United States national phase application which claims priority to International Application No. PCT/US2012/065223, filed Nov. 15, 2012, the entire disclosure of which is hereby incorporated herein by reference

TECHNICAL FIELD OF THE INVENTION

This invention relates, in general, to equipment utilized in conjunction with operations performed in relation to subterranean wells and, in particular, to a downhole chemical injection system having a density barrier operable for preventing production fluid migration into the chemical injection line.

BACKGROUND OF THE INVENTION

Without limiting the scope of the present invention, its background is described with reference to chemical injection into a wellbore that traverses a hydrocarbon bearing subterranean formation, as an example.

It is well known in the subterranean well production art that wellbore chemical management can be important in optimizing fluid production as well as in minimizing well downtime and expensive intervention. For example, applications of chemical injection systems include scale, asphaltines, emulsions, hydrates, defoaming, paraffin, scavengers, corrosion, demulsifiers and the like. In a typically installation, the chemical injection system includes a chemical injection mandrel interconnected in the tubing string and having an injection port positioned at the desired injection location. One or more chemicals are supplied to the chemical injection mandrel via a chemical injection line that extends to the surface and is coupled to a chemical injection pumping unit. Various control and communication lines may also extend between the chemical injection mandrel and the surface control equipment. The chemical injection mandrel generally includes a check valve positioned between the chemical injection line and the injection port. The purpose of the check valve is to prevent wellbore fluids, such as production gas, oil or water, from migrating into the chemical injection system upstream of the check valve.

It has been found, however, that during the production life of the well as the bottom hole pressure depletes, the higher density of the chemical injection fluid compared with the production fluids generates a high hydrostatic differential, which forces the fluid level in the chemical injection line to be balanced with the bottom hole pressure at the injection point any time chemical injection is interrupted. For example, in certain installations, such deep water installations or multipoint chemical injection installations, if the bottom hole pressure gets equalized at the chemical injection point, the well fluids will try to migrate through the check valve into the chemical injection line, resulting in a risk to generate hydrates at the subsea level. In these installations, even the option of closing a surface control valve could generate a vacuum in the chemical injection line resulting in a risk of precipitate solids building up in the injection line, which can plug the injection line.

Therefore, a need has arisen for an improved chemical injection system operable for optimizing wellbore chemical management and fluid production. A need has also arisen for such an improved chemical injection system that is operable for deep water, depleted well and/or multipoint chemical injection installations. Further, a need has arisen for such an improved chemical injection system that is operable to prevent production fluid migration into the injection line.

SUMMARY OF THE INVENTION

The present invention disclosed herein is directed to an improved chemical injection system operable for optimizing wellbore chemical management and fluid production. The improved chemical injection system of the present invention is operable for deep water, depleted well and/or multipoint chemical injection installations. In addition, the improved chemical injection system of the present invention is operable to prevent production fluid migration into the injection line.

In one aspect, the present invention is directed to a downhole chemical injection system for positioning in a well. The system includes a generally tubular mandrel having an axially extending internal passageway and an exterior. The mandrel includes an injection port in fluid communication with at least one of the internal passageway and the exterior of the mandrel. A chemical injection line is coupled to the mandrel and is operable to transport a treatment fluid from a surface installation to the mandrel. A check valve is supported by the mandrel and is in downstream fluid communication with the chemical injection line. A density barrier is fluidically positioned between the check valve and the injection port. The density barrier has an axial loop and a circumferential loop relative to the mandrel, thereby preventing migration of production fluid from the injection port to the check valve regardless of the directional orientation of the well.

In one embodiment, the production fluid is at least one of a liquid and a gas having a density that is lower than the density of the treatment fluid. In some embodiments, the axial loop may be a pair of axially extending tubing sections. In certain embodiments, the circumferential loop may be a single circumferentially extending tubing section that preferably extends at least 180 degree around the mandrel. In other embodiments, the circumferential loop may be a pair of circumferentially extending tubing sections that preferably extends at least 180 degree around the mandrel. In one embodiment, at least a portion of the axial loop may be a tubing section that does not extend exclusively in the axial direction. In other embodiments, at least a portion of the circumferential loop may be a tubing section that does not extend exclusively in the circumferential direction. In some embodiments, the axial loop and the circumferential loop may form an omnidirectional low density fluid trap.

In another aspect, the present invention is directed to a downhole chemical injection system for positioning in a well. The system includes a generally tubular mandrel having an axially extending internal passageway and an exterior. The mandrel includes an injection port in fluid communication with at least one of the internal passageway and the exterior of the mandrel. A chemical injection line is coupled to the mandrel and is operable to transport a treatment fluid from a surface installation to the mandrel. A density barrier is fluidically positioned between the chemical injection line and the injection port. The density barrier has an axial loop and a circumferential loop relative to the mandrel, thereby preventing migration of production fluid from the injection port to the chemical injection line regardless of the directional orientation of the well.

In a further aspect, the present invention is directed to a downhole chemical injection system that is operably connectable to a surface treatment fluid pump via a chemical injection line and that is operably positionable in a well. The system includes a generally tubular mandrel having an axially extending internal passageway and an exterior. The mandrel includes an injection port in fluid communication with at least one of the internal passageway and the exterior of the mandrel. The mandrel also including an inlet operable for fluid connection with the chemical injection line. A check valve is supported by the mandrel and is in downstream fluid communication with the inlet. A density barrier is fluidically positioned between the check valve and the injection port. The density barrier has an axial loop and a circumferential loop relative to the mandrel, thereby preventing migration of production fluid from the injection port to the check valve regardless of the directional orientation of the well.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
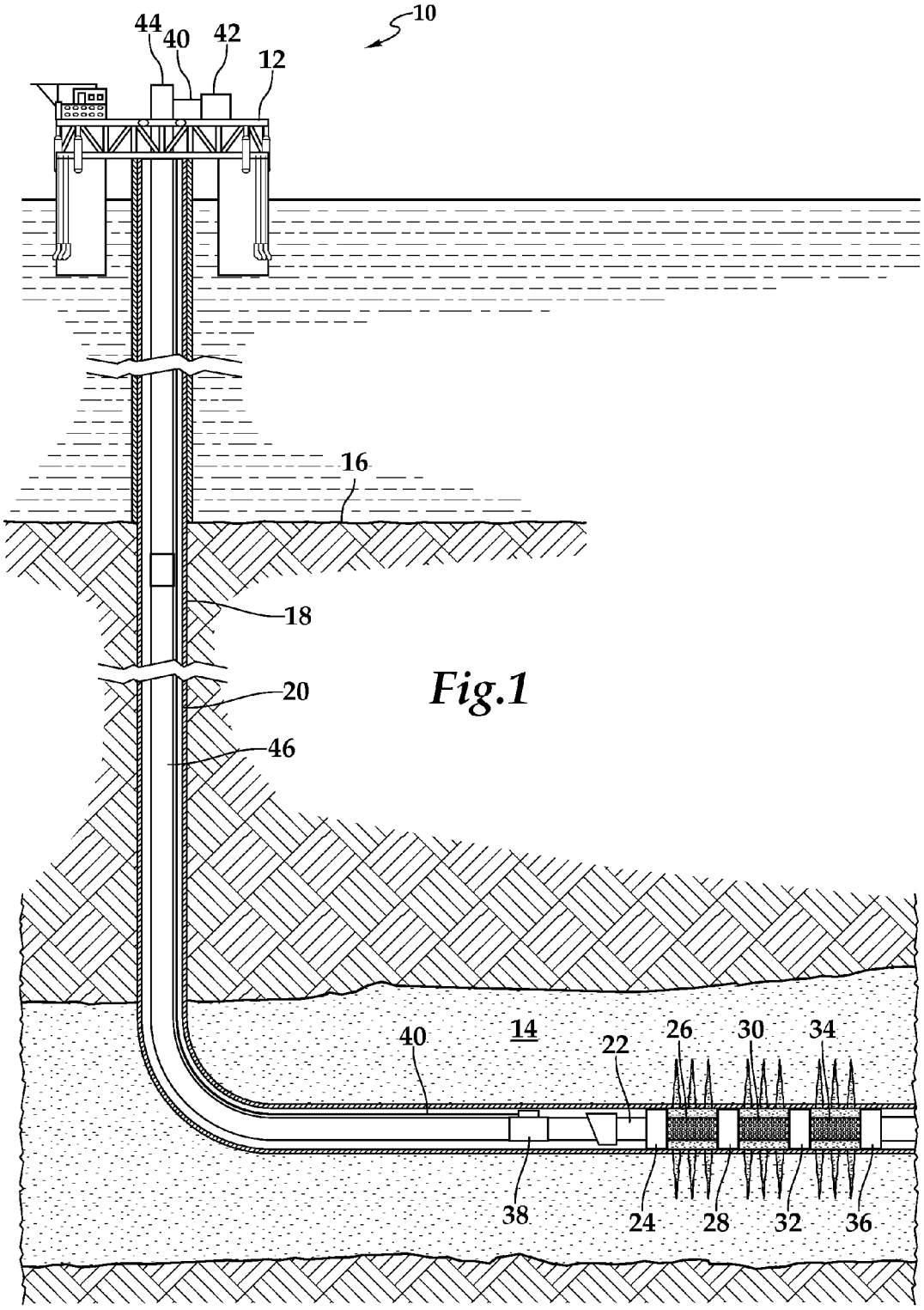
FIG. 1 is a schematic illustration of an offshore platform operating a downhole chemical injection system having a density barrier according to an embodiment of the present invention.

Referring initially to FIG. 1, a downhole chemical injection system is being operated in a well positioned beneath an offshore oil or gas production platform that is schematically illustrated and generally designated 10. A semi-submersible platform 12 is centered over submerged oil and gas formation 14 located below sea floor 16. A wellbore 18 extends through the various earth strata including formation 14 and has a casing string 20 cemented therein. Disposed in a substantially horizontal portion of wellbore 18 is a completion assembly 22 that includes various tools such as a packer 24, sand control screen assembly 26, packer 28, sand control screen assembly 30, packer 32, sand control screen assembly 34 and packer 36. In addition, completion assembly 22 includes a chemical injection mandrel 38 of the present invention having a density barrier for preventing migration of production fluid into the chemical injection system regardless of the directional orientation of wellbore 18. In the illustrated embodiment, a chemical injection line 40 extends from a surface installation depicted as a treatment fluid pump 42 passing through a wellhead 44. Chemical injection line 40 delivers treatment chemicals from pump 42 to chemical injection mandrel 38. Applications of the chemical injection system include, for example, scale, asphaltines, emulsions, hydrates, defoaming, paraffin, scavengers, corrosion, demulsifiers and the like. Completion assembly 22 is interconnected within a tubing string 46 that extends to the surface and provides a conduit for the production of formation fluids, such as oil and gas, to wellhead 44.

Importantly, as explained in detail below, even though FIG. 1 depicts the chemical injection mandrel of the present invention in a horizontal section of the wellbore, it should be understood by those skilled in the art that the chemical injection mandrel of the present invention is specifically designed for use in wellbores having a variety of directional orientations including vertical wellbores, inclined wellbores, slanted wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the chemical injection mandrel of the present invention is equally well suited for use in onshore operations. Further, even though FIG. 1 depicts a cased hole completion, it should be understood by those skilled in the art that the chemical injection mandrel of the present invention is equally well suited for use in open hole completions. In addition, even though FIG. 1 depicts an single chemical injection installation with a dedicated chemical injection line, it should be understood by those skilled in the art that the chemical injection mandrel of the present invention is equally well suited for use in multipoint chemical injection installations where two or more chemical injection mandrels are installed that share a common chemical injection line.

Figure 2A:
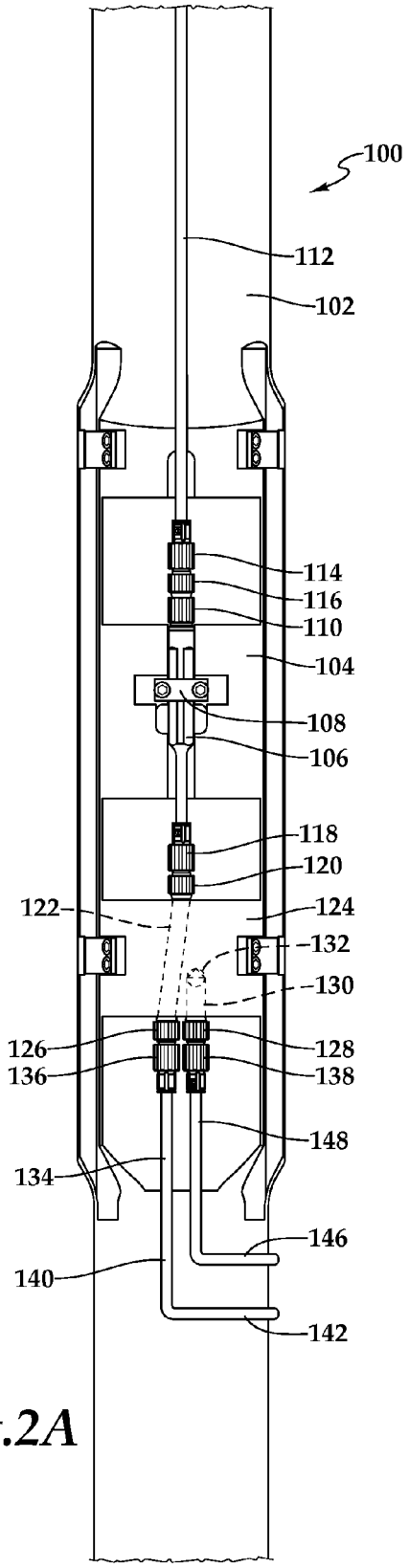
FIG. 2A is a top view of a downhole chemical injection system having a density barrier according to an embodiment of the present invention.
Figure 2B:
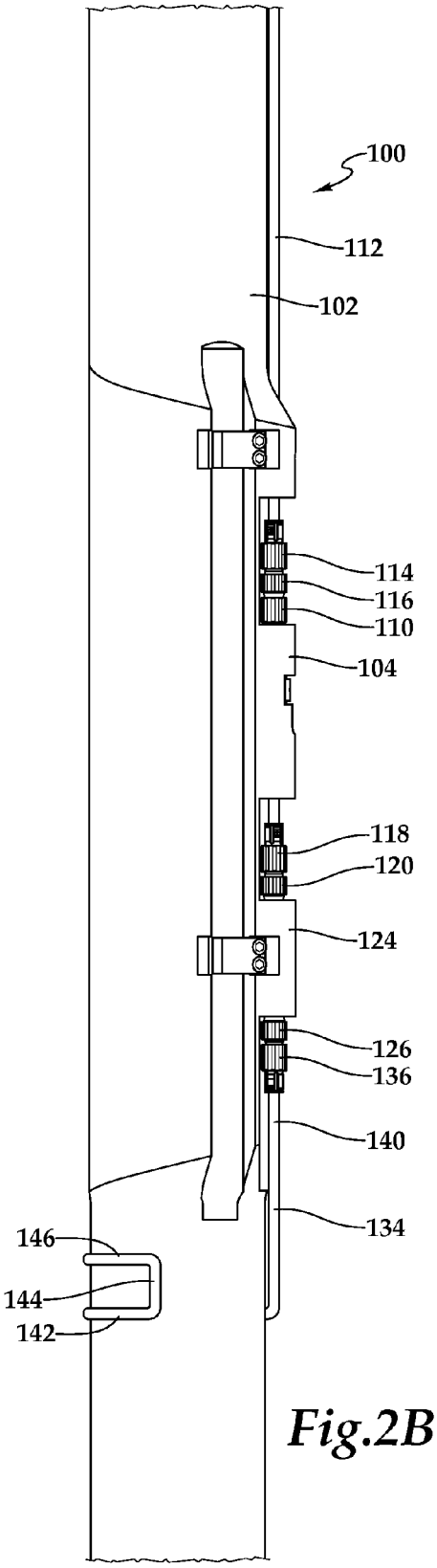
FIG. 2B is a side view of a downhole chemical injection system having a density barrier according to an embodiment of the present invention.

Referring next to FIGS. 2A-2B, therein is depicted a downhole chemical injection system of the present invention that is generally designated 100. Downhole chemical injection system 100 includes a generally tubular mandrel 102 having an axially extending internal passageway that forms a portion of the flow path for the production of formation fluids through the production tubing. As used herein the term "axial" refers to a direction that is generally parallel to the central axis of mandrel 102, the term "radial" refers to a direction that extends generally outwardly from and is generally perpendicular to the central axis of mandrel 102 and the term "circumferential" refers to a direction generally perpendicular to the radial direction and the axial direction of mandrel 102. Mandrel 102 includes a support assembly 104. A fluid flow control element depicted as check valve 106 is received within support assembly 104 and is secured therein with a retainer assembly 108. Check valve 106 is designed to allow fluid flow in the down direction of FIG. 2A, which is downhole after installation, and prevent fluid flow in the up direction of FIG. 2A, which is uphole after installation. Check valve 106 may include redundant checks such as one hard seat and one soft seat. In the illustrated embodiment, check valve 106 includes a coupling 110 that serves as an inlet for the treatment fluid into mandrel 102. The treatment fluid is delivered to mandrel 102 in a chemical injection line 112, which preferably extends to the surface and is coupled to a treatment fluid pump as described above. At its lower end, chemical injection line 112 includes a coupling 114. Coupling 110 of check valve 106 and coupling 114 of chemical injection line 112 are connected together at union 116 wherein a fluid tight connection is made using, for example, metal-to-metal ferrules or other high pressure fluid tight connection technique.

At its lower end, check valve 106 includes a coupling 118 that has a fluid tight connection with union 120. Union 120 represents an inlet to a flow passage 122 that extends through block 124 and has an outlet represented by union 126. A union 128 represents an inlet to a flow passage 130 that extends partially through block 124. In the illustrated embodiment, flow passage 130 is in fluid communication with an injection port 132 that is in fluid communication with the internal passageway mandrel 102. A density barrier 134 is connected to unions 126, 128 in a fluid tight manner by couplings 136, 138, respectively. Density barrier 134 forms a loop between unions 126, 128. Density barrier 134 includes a substantially axially extending tubing section 140, a substantially circumferentially extending tubing section 142, a substantially axially extending tubing section 144, a substantially circumferentially extending tubing section 146 and a substantially axially extending tubing section 148. Together, tubing section 140, tubing section 144 and tubing section 148 form an axial loop. Likewise, tubing section 142 and tubing section 146 form a circumferential loop. Preferably, the circumferential loop extends around mandrel 102 at least 180 degrees. In the illustrated embodiment, the circumferential loop extends around mandrel 102 for approximately 270 degrees. As explained in greater detail below, the axial loop and the circumferential loop form an omnidirectional low density fluid trap that prevents migration of production fluid from injection port 132 to check valve 106 regardless of the directional orientation of the well in which mandrel 102 is installed.

Figure 3A:
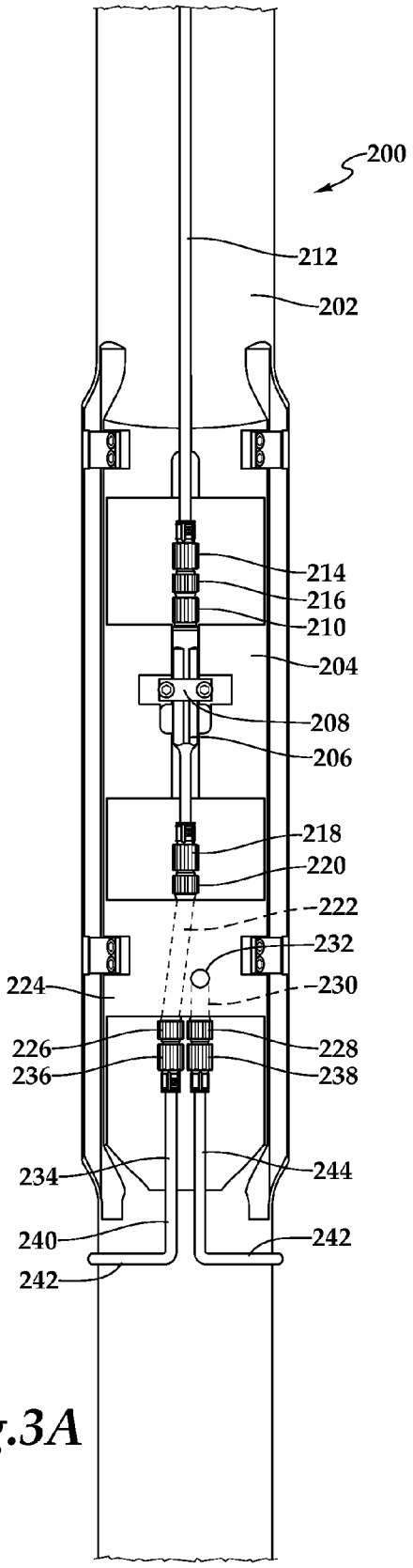
FIG. 3A is a top view of a downhole chemical injection system having a density barrier according to an embodiment of the present invention.
Figure 3B:
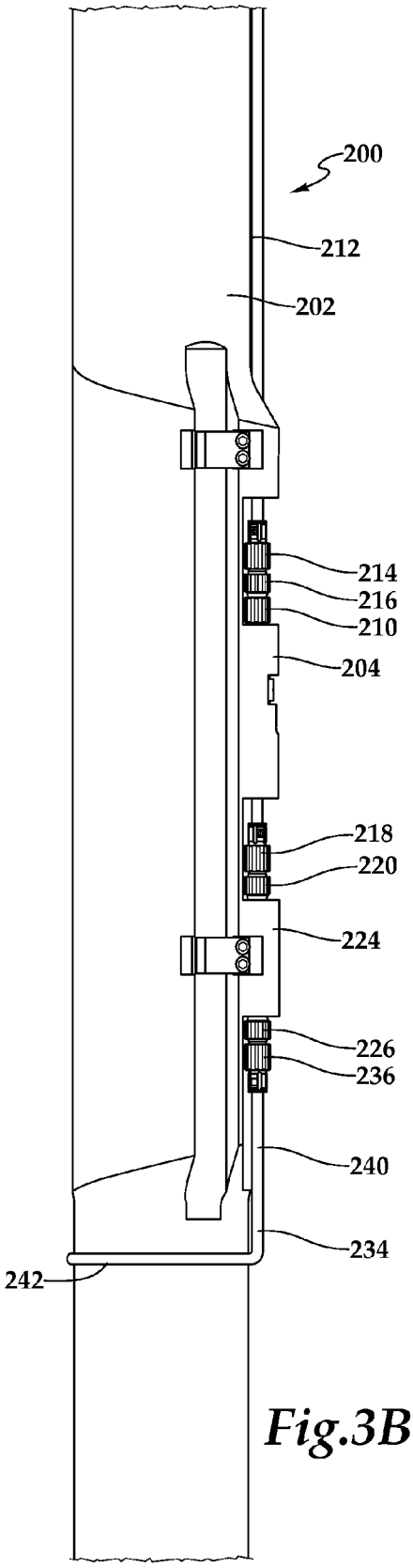
FIG. 3B is a side view of a downhole chemical injection system having a density barrier according to an embodiment of the present invention.

Referring next to FIGS. 3A-3B, therein is depicted a downhole chemical injection system of the present invention that is generally designated 200. Downhole chemical injection system 200 includes a generally tubular mandrel 202 having an axially extending internal passageway that forms a portion of the flow path for the production of formation fluids through the production tubing. Mandrel 202 includes a support assembly 204. A fluid flow control element depicted as check valve 206 is received within support assembly 204 and is secured therein with a retainer assembly 208. Check valve 206 is designed to allow fluid flow in the down direction of FIG. 3A, which is downhole after installation, and prevent fluid flow in the up direction of FIG. 3A, which is uphole after installation. In the illustrated embodiment, check valve 206 includes a coupling 210 that serves as an inlet for the treatment fluid into mandrel 202. The treatment fluid is delivered to mandrel 202 in a chemical injection line 212, which preferably extends to the surface and is coupled to a treatment fluid pump as described above. At its lower end, chemical injection line 212 includes a coupling 214. Coupling 210 of check valve 206 and coupling 214 of chemical injection line 212 are connected together at union 216 wherein a fluid tight connection is made.

At its lower end, check valve 206 includes a coupling 218 that has a fluid tight connection with union 220. Union 220 represents an inlet to a flow passage 222 that extends through block 224 and has an outlet represented by union 226. A union 228 represents an inlet to a flow passage 230 that extends partially through block 224. In the illustrated embodiment, flow passage 230 is in fluid communication with an injection port 232 that is in fluid communication with the exterior of mandrel 202. A density barrier 234 is connected to unions 226, 228 in a fluid tight manner by coupling 236, 238, respectively. Density barrier 234 forms a loop between unions 226, 228. Density barrier 234 includes a substantially axially extending tubing section 240, a substantially circumferentially extending tubing section 242 and a substantially axially extending tubing section 244. Together, tubing section 240 and tubing section 244 form an axial loop. Likewise, tubing section 242 forms a circumferential loop. In the illustrated embodiment, the circumferential loop extends around mandrel 202 nearly 360 degrees. As explained in greater detail below, the axial loop and the circumferential loop form an omnidirectional low density fluid trap that prevents migration of production fluid from injection port 232 to check valve 206 regardless of the directional orientation of the well in which mandrel 202 is installed.

Figure 4A:
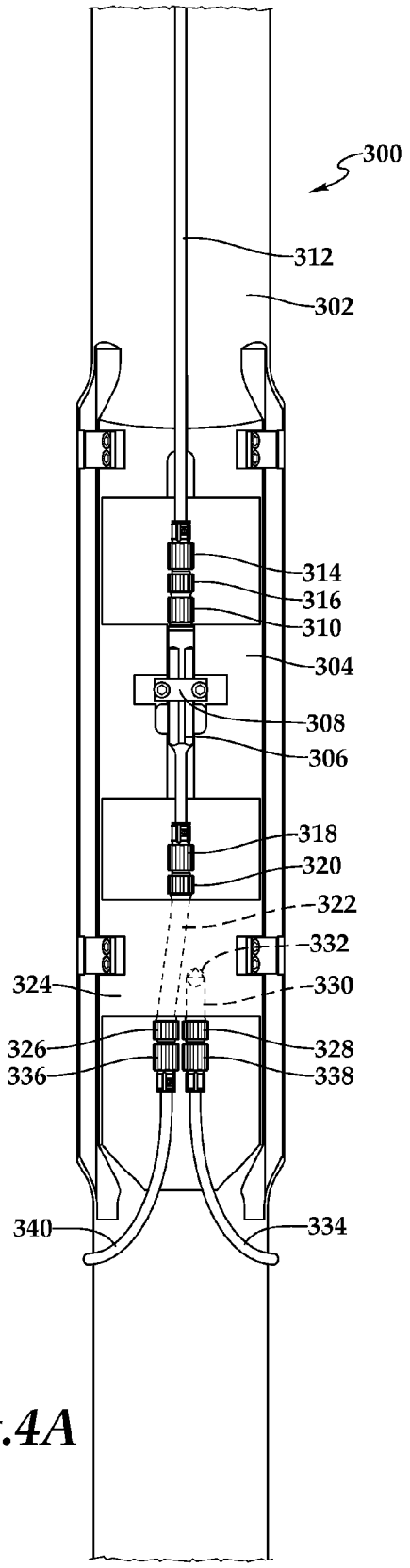
FIG. 4A is a top view of a downhole chemical injection system having a density barrier according to an embodiment of the present invention.
Figure 4B:
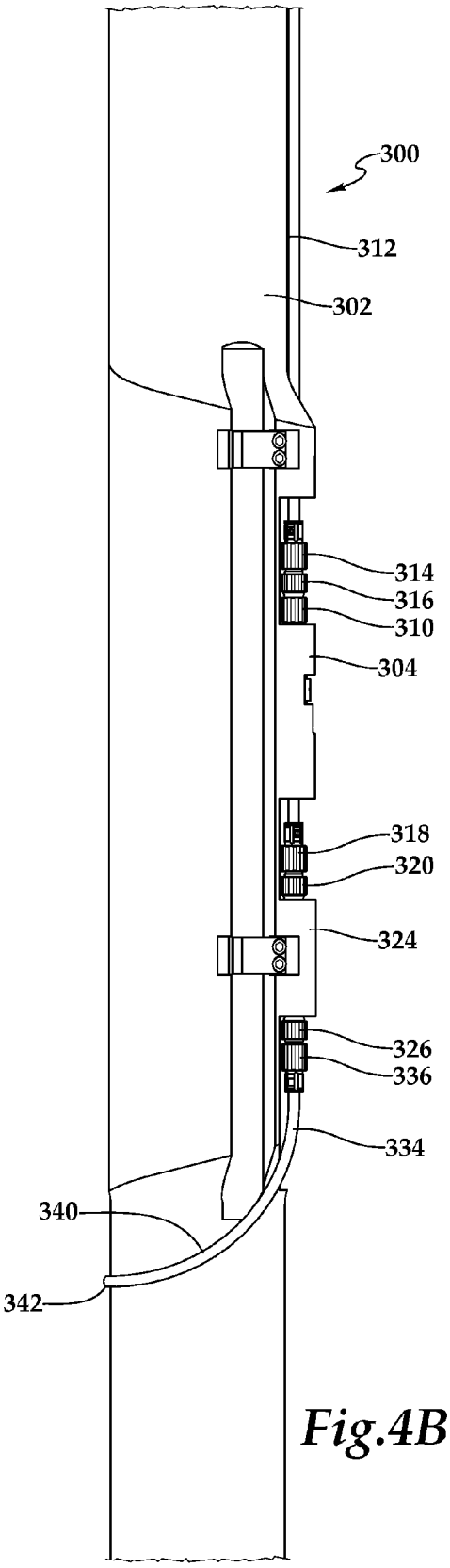
FIG. 4B is a side view of a downhole chemical injection system having a density barrier according to an embodiment of the present invention.

Referring next to FIGS. 4A-4B, therein is depicted a downhole chemical injection system of the present invention that is generally designated 300. Downhole chemical injection system 300 includes a generally tubular mandrel 302 having an axially extending internal passageway that forms a portion of the flow path for the production of formation fluids through the production tubing. Mandrel 302 includes a support assembly 304. A fluid flow control element depicted as check valve 306 is received within support assembly 304 and is secured therein with a retainer assembly 308. Check valve 306 is designed to allow fluid flow in the down direction of FIG. 4A, which is downhole after installation, and prevent fluid flow in the up direction of FIG. 4A, which is uphole after installation. In the illustrated embodiment, check valve 306 includes a coupling 310 that serves as an inlet for the treatment fluid into mandrel 302. The treatment fluid is delivered to mandrel 302 in a chemical injection line 312, which preferably extends to the surface and is coupled to a treatment fluid pump as described above. At its lower end, chemical injection line 312 includes a coupling 314. Coupling 310 of check valve 306 and coupling 314 of chemical injection line 312 are connected together at union 316 wherein a fluid tight connection is made.

At its lower end, check valve 306 includes a coupling 318 that has a fluid tight connection with union 320. Union 320 represents an inlet to a flow passage 322 that extends through block 324 and has an outlet represented by union 326. A union 328 represents an inlet to a flow passage 330 that extends partially through block 324. In the illustrated embodiment, flow passage 330 is in fluid communication with an injection port 332 that is in fluid communication with the interior passageway of mandrel 302. A density barrier 334 is connected to unions 326, 328 in a fluid tight manner by coupling 336, 338, respectively. Density barrier 334 forms a loop between unions 326, 328. Density barrier 334 includes a tubing section 340 that extends downwardly and outwardly from union 326 to a lowermost point indicated at location 342 then extends upwardly and inwardly to union 328. As such, tubing section 340 forms an axial loop and a circumferential loop, wherein the circumferential loop extends around mandrel 302 nearly 360 degrees. It is noted that in forming the axial loop, tubing section 340 does not extend exclusively in the axial direction and in forming the circumferential loop, tubing section 340 does not extend exclusively in the circumferential direction. As explained in greater detail below, the axial loop and the circumferential loop form an omnidirectional low density fluid trap that prevents migration of production fluid from injection port 332 to check valve 306 regardless of the directional orientation of the well in which mandrel 302 is installed.

The operation of a downhole chemical injection system of the present invention will now be described. Once the production tubing string and completion assembly are installed in the well and production of formation fluids has commenced, it may be desirable to inject a treatment fluid into the interior of the production tubing or into the annulus surrounding the production tubing. In either case, a downhole chemical injection system of the present invention may be used, for example, for internal injection, systems 100 or 300 discussed above have internal injection ports 132, 323, respectively. Alternatively, for external injection, system 200 discussed above has external injection port 232. In either case, the desired treatment fluid may be pumped from the surface to the mandrel in the chemical injection line. Under normal operation conditions, the treatment fluid will enter the mandrel at the inlet, pass through the check valve and flow passage in the block, before entering the density barrier. The treatment fluid then passes through the axial loop and the circumferential loop of the density barrier before reentering the block at the inlet to the fluid passage that communicates the treatment fluid to the injection port.

If the injection of the treatment fluid stops, a portion of the treatment fluid in the density barrier may exit through the injection port with low density formation fluid entering the injection port to take its place. The density barrier of the present invention, however, provides an omnidirectional low density fluid trap due to its integrated axial and circumferential loops. For example, in a vertical installation, the treatment fluid in the axial loop of the density barrier is not displaced by the lower density formation fluid entering the injection port. Accordingly, the formation fluid is disallowed from migrating to the check valve and therefore to the chemical injection line in a vertical installation of a downhole chemical injection system of the present invention. In a horizontal installation, wherein some or even all of the treatment fluid in the axial loop of the density barrier may exit through the injection port, the treatment fluid in at least a portion of the circumferential loop of the density barrier will not escape and is not displaced by the lower density formation fluid entering the injection port. As long as the circumferential loop extends at least 180 degrees around the mandrel, this remains true regardless of the circumferential orientation of the mandrel with respect to the well. Accordingly, the formation fluid is disallowed from migrating to the check valve and therefore to the chemical injection line in a horizontal installation of a downhole chemical injection system of the present invention. In any other directional orientation of the well between the vertical and the horizontal, both the axial loop and the circumferential loop of the density barrier retain at least some of the treatment fluid which is not displaced by any lower density formation fluid entering the injection port. Accordingly, in any such directional orientation, the formation fluid is disallowed from migrating to the check valve and therefore to the chemical injection line by the density barrier of the downhole chemical injection system of the present invention.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole chemical injection system for positioning in a well, the system comprising:

a generally tubular mandrel having an axially extending internal passageway and an exterior, the mandrel including an injection port in fluid communication with at least one of the internal passageway and the exterior of the mandrel;

a chemical injection line coupled to the mandrel and operable to transport a treatment fluid from a surface installation to the mandrel;

a check valve supported by the mandrel and in downstream fluid communication with the chemical injection line; and a density barrier fluidically positioned between the check valve and the injection port, the density barrier having an axial loop and a circumferential loop relative to the mandrel, thereby preventing migration of production fluid from the injection port to the check valve regardless of the directional orientation of the well.

2. The downhole chemical injection system as recited in claim 1 wherein the production fluid is at least one of a liquid and a gas having a density that is lower than the density of the treatment fluid.

3. The downhole chemical injection system as recited in claim 1 wherein the axial loop further comprises a pair of axially extending tubing sections.

4. The downhole chemical injection system as recited in claim 1 wherein the circumferential loop further comprises a single circumferentially extending tubing section.

5. The downhole chemical injection system as recited in claim 4 wherein the circumferentially extending tubing section extends at least 180 degree around the mandrel.

6. The downhole chemical injection system as recited in claim 1 wherein the circumferential loop further comprises a pair of circumferentially extending tubing sections.

7. The downhole chemical injection system as recited in claim 6 wherein each of the circumferentially extending tubing sections extends at least 180 degree around the mandrel.

8. The downhole chemical injection system as recited in claim 1 wherein at least a portion of the axial loop further comprises a tubing section that does not extend exclusively in the axial direction.

9. The downhole chemical injection system as recited in claim 1 wherein at least a portion of the circumferential loop further comprises a tubing section that does not extend exclusively in the circumferential direction.

10. The downhole chemical injection system as recited in claim 1 wherein the axial loop and the circumferential loop form an omnidirectional low density fluid trap.

11. A downhole chemical injection system for positioning in a well, the system comprising:

a generally tubular mandrel having an axially extending internal passageway and an exterior, the mandrel including an injection port in fluid communication with at least one of the internal passageway and the exterior of the mandrel;

a chemical injection line coupled to the mandrel and operable to transport a treatment fluid from a surface installation to the mandrel; and a density barrier fluidically positioned between the chemical injection line and the injection port, the density barrier having an axial loop and a circumferential loop relative to the mandrel, thereby preventing migration of production fluid from the injection port to the chemical injection line regardless of the directional orientation of the well.

12. The downhole chemical injection system as recited in claim 11 wherein the axial loop further comprises a pair of axially extending tubing sections.

13. The downhole chemical injection system as recited in claim 11 wherein the circumferential loop further comprises a single circumferentially extending tubing section that extends at least 180 degree around the mandrel.

14. The downhole chemical injection system as recited in claim 11 wherein the circumferential loop further comprises a pair of circumferentially extending tubing sections that extends at least 180 degree around the mandrel.

15. The downhole chemical injection system as recited in claim 11 wherein the axial loop and the circumferential loop form an omnidirectional low density fluid trap.

16. A downhole chemical injection system operably connectable to a surface treatment fluid pump via a chemical injection line and operably positionable in a well, the system comprising:

a generally tubular mandrel having an axially extending internal passageway and an exterior, the mandrel including an injection port in fluid communication with at least one of the internal passageway and the exterior of the mandrel, the mandrel including a inlet operable for fluid connection with the chemical injection line;

a check valve supported by the mandrel and in downstream fluid communication with the inlet; and a density barrier fluidically positioned between the check valve and the injection port, the density barrier having an axial loop and a circumferential loop relative to the mandrel, thereby preventing migration of production fluid from the injection port to the check valve regardless of the directional orientation of the well.

17. The downhole chemical injection system as recited in claim 16 wherein the axial loop further comprises a pair of axially extending tubing sections.

18. The downhole chemical injection system as recited in claim 16 wherein the circumferential loop further comprises a single circumferentially extending tubing section that extends at least 180 degree around the mandrel.

19. The downhole chemical injection system as recited in claim 16 wherein the circumferential loop further comprises a pair of circumferentially extending tubing sections that extends at least 180 degree around the mandrel.

20. The downhole chemical injection system as recited in claim 16 wherein the axial loop and the circumferential loop form an omnidirectional low density fluid trap.

* * * * *